United States Patent [19]

Nelson

[11] Patent Number: 5,007,226

[45] Date of Patent: Apr. 16, 1991

[54] INSULATED REFRIGERATOR DOOR CONSTRUCTION

[75] Inventor: Thomas E. Nelson, Anchorage, Ky.

[73] Assignee: Soltech, Inc., Shelbyville, Ky.

[21] Appl. No.: 345,967

[22] Filed: May 1, 1989

[51] Int. Cl.[5] ..... E04B 1/78; E04C 2/34

[52] U.S. Cl. ..... 52/809; 52/407

[58] Field of Search ..... 52/802, 803, 806, 808, 52/809, 406, 407, 815, 145

[56] References Cited

U.S. PATENT DOCUMENTS

| | | | |
|---|---|---|---|
| 2,304,757 | 12/1942 | Arthur . | |
| 2,350,513 | 6/1944 | Leadbetter | 52/145 |
| 2,368,837 | 2/1945 | Hubacker . | |
| 2,451,286 | 10/1948 | Heritage . | |
| 2,553,832 | 5/1951 | Richard . | |
| 2,670,820 | 3/1954 | Worthington | 52/407 |
| 2,817,124 | 12/1957 | Dybvig . | |
| 2,863,179 | 12/1958 | Gaugler . | |
| 2,911,076 | 11/1959 | Saunders et al. | 52/802 |
| 2,939,811 | 6/1960 | Dillon . | |
| 3,025,683 | 3/1962 | Baker et al. . | |
| 3,078,003 | 2/1963 | Kesling . | |
| 3,307,318 | 3/1967 | Bauman . | |
| 4,808,457 | 2/1989 | Kruck et al. . | |

*Primary Examiner*—David A. Scherbel
*Assistant Examiner*—Michele A. Van Patten
*Attorney, Agent, or Firm*—Woodard, Emhardt, Naughton, Moriarty & McNett

[57] ABSTRACT

An insulated refrigerator door designed and arranged to enable a flow path for air from the interior of the refrigerator through the door insulation includes an outer door panel of a generally rectangular shape having a surrounding peripheral frame so as to define an interior recessed area, an inner door panel having a plurality of vent holes arranged in two spaced-apart series and an insulation panel disposed between the inner and outer door panels. The insulation panel is configured with a first layer of porous enclosing material, an opposite layer of enclosing material and loose discrete insulation material disposed therebetween. The porous enclosing layer of material is disposed adjacent the inner door panel such that the vent holes of the inner door panel communicate directly with the porous nature of the enclosing layer so as to enable a natural flow of air and moisture from the interior of the refrigerator through the loose, discrete insulation material.

4 Claims, 3 Drawing Sheets

INSULATED REFRIGERATOR DOOR CONSTRUCTION

BACKGROUND OF THE INVENTION

The present invention relates in general to insulation concepts for kitchen appliances, such as refrigerators, and in Particular to the insulation design for refrigerator doors.

Refrigerator doors typically include an outer panel whose outer surface is designed for aesthetics and an inner panel which is structured in order to store food and beverage. Between these two panels or surfaces is an insulation layer of a suitable packing or filler. Although not all refrigerator doors are the same, for example, some do not include in-door storage, the basic structure of inner and outer panels separated by insulation is the standard today. Some prior designs have also included openings in the door in order to allow air flow to the insulation. While the present invention includes vent openings which enable air flow through the insulation, the present invention is structurally different from any of the earlier vented designs in a number of important aspects.

The following patent references are representative of refrigerator door designs which typify prior constructions:

| Patent No. | Patentee | Issue Date |
|---|---|---|
| 2,553,832 | Richard | 05/22/1951 |
| 2,304,757 | Arthur | 12/08/1942 |
| 3,025,683 | Baker et al. | 03/20/1962 |
| 2,368,837 | Hubacker | 02/06/1945 |
| 2,451,286 | Heritage | 10/12/1948 |
| 4,808,457 | Kruck et al. | 02/28/1989 |
| 2,817,124 | Dybvig | 12/24/1957 |
| 3,078,003 | Kesling | 02/19/1963 |
| 3,307,318 | Bauman | 03/07/1967 |
| 2,939,811 | Dillon | 06/07/1960 |
| 2,863,179 | Gaugler | 12/09/1958 |

Richard discloses a refrigerator door construction which includes a lower freezing chamber door 10 and an upper humidity chamber door 11. The inner panel of each door is provided with a plurality or series of vents. Each door is filled with rock wool insulation and the vents allow air flow into the rock wool insulation in order to remove any moisture from the insulation. The invention focuses on the placement of the vents in order to facilitate circulation of air by convection and on a reduction in the number of vents due to their location. The rock wool insulation is not encased in any type of pouch or enclosure and thus may not be fabricated off-line and later assembled into the door unit at the production line stage. The inner and outer shells of each door are assembled together by a flange and seal combination.

Arthur discloses a refrigerator construction wherein the door or cover 6 includes in its inner wall a single orifice 26 so as to vent the glass wool filled interior of cover 6 into a refrigerating space 8. Arthur is similar to Richard in that the insulation is not encased or arranged in any type of pouch or panel and with only a single opening there is no means to establish air circulation through the insulation. As the Arthur patent indicates, this orifice 26 allows the insulation to breathe.

Baker et al. discloses an air circulation system and structure for a refrigerated cabinet. Air is blown or circulated through the cabinet by means of a blower which is disposed in a passageway in the cabinet door. The flow path is from the passageway initially, through the refrigerated cabinet and then back into the passageway by means of one of several circulatory paths. This device also utilizes a baffle arrangement surrounding the cooling element in the refrigerated cabinet in order to direct the movement of air flowing from the passageway in the door over the cooling elements, thereby affording noticeably cooler circulating air than when a baffle is not used. This particular device does not include any type of vent openings for the free or natural flow of air and moisture from the refrigerated cabinet through the insulation in the door.

Hubacker discloses a refrigerator cabinet construction which includes a hollow housing defined by spaced walls. The walls contain insulating material and the housing is provided with an evaporator for cooling the interior. At least one of the interior walls is formed with a plurality of perforations whereby the evaporator may dehydrate therethrough any moisture that may be contained within the associated spaced walls. This particular structure utilizes a forced circulation by means of the evaporator and as with Richard and with Arthur and Baker et al., the insulation which is present is not in panel form nor in self-contained pouch form.

Heritage discloses a refrigerator construction having means to restrict moisture in the walls of the cabinet. The Heritage disclosure makes reference to concerns over wetting of insulation and discusses the physical properties of wet and dry air and the dehydrating action which occurs in refrigerator operation. This particular device attempts to avoid various defects or problems with earlier refrigerator constructions by constructing the refrigerator door in such a way as to minimize or prevent any pumping action or breathing in and out of air. Another object of the invention is to utilize the dehydrating action of the food compartments in order to impose drying conditions on the insulation by the details of its construction. This particular device does not include any type of presealed or encased insulation pouch, nor are there any vented openings or apertures for a flow-through of air.

Kruck et al. discloses a self-contained thermal insulation panel of generally rectangular form which is suitable for placement within the walls or doors of a refrigerator cabinet. This thermal insulation panel consists of a hermetically sealed envelope surrounding an assembled framework defining a plurality of thin parallel internal cavities. The cavities are formed by a plurality of thin, stretched-out sheets, each preferably with at least one reflective face, spaced apart by thin interlocking peripheral gaskets between a top and a bottom frame member. Although an insulation panel construction is provided by this particular reference, the entire focus is on the details of the construction of the panel which does not include any preconstructed and enclosed pouches of insulation nor is there any indication of a porous or permeable outer skin for the insulation panel so as to allow the natural flow of air and moisture through the encased insulation.

Dybvig discloses a refrigerator apparatus which includes a unitary bag having at least two side-by-side compartments separated from each other by a common imperferate wall or membrane and charging one of the compartments with an insulating filler material and a gas of low heat conductivity and hermetically sealing the same, and encasing in the other compartment a cushion or layer of compressible insulation material. The outer wall of the gas-filled compartment and the inner wall or membrane of that compartment are formed of a material impervious to the passage of any insulating gas, air or moisture while the outer wall of the other compartment is Preferably substantially impervious to the passage of moisture therethrough, but is sufficiently pervious to the passage of air in order to permit the compartment to breathe in order to equalize the pressure between the latter compartment and the atmosphere. Although this particular apparatus appears to focus more on the specific construction of the insulation compartments, including the characteristics of the encasing skin and the specifics of the construction, there is little or no attention given to how this particular insulation panel may be adapted to current refrigerator door designs such as by providing vent openings in the inner panel of the door. Although the outer wall 12 is formed of a moisture impervious material such as polyethylene having one or more pin holes or breather openings as indicated at 13, there is no indication of utilizing this panel in a refrigerator door nor in providing vent openings in that door in order to create a natural flow of air from the interior of the refrigerator through the insulation of the door.

Kesling discloses a refrigerator cabinet construction which focuses specifically on the insulation panel but does not indicate any intent in the design of that panel to create a flow loop for air and moisture from the cabinet interior through the insulation of the door. As has previously been commented upon, the insulation of this particular construction simply appears to be foamed or filled insulation between two panels and is not a separately constructed insulation panel.

Bauman discloses a foam plastic filler method which may be utilized in the door and side walls of a refrigerator and pertains specifically to a method for filling void spaces with synthetic plastic foam utilizing a sealed bag of compressed synthetic plastic foam and placing this sealed bag in an insulating spaced wall for filling cracks and voids. Initially a bag of insulation is prepared and sealed and air is expelled from the bag by the application of a vacuum. The external atmospheric pressure maintains the foam in a compressed state and only when the bag is opened or punctured to allow the entry of air will the foam reexpand to its normal volume, after the sealed bag has been placed in a useful position such as in a joint or between spaced walls. Certain benefits can result by using the compressed foam package, releasing the vacuum once in place so that it will act to completely fill the void.

Dillon discloses a heat insulating unit for refrigerator cabinets including a heat-insulating unit of deformable pillow-like construction which is adapted to be conformed to the space disposed between the inner and outer metal walls of a refrigerator cabinet or the like. The unit includes a hermetically sealed bag having deformable sheet-like walls of low thermoconductivity that are highly impervious to gas. The sealed bag contains both a deformable mass of porous solid heat-insulating material and a charge of gas at substantially atmospheric pressure. The charge of gas is of a thermoconductivity lower than that of air and essentially comprises a mixture of carbon dioxide and dichloride difluoromethane. There is no attention given in this particular reference to any type of vented structure for the natural flow of air and moisture through the refrigerator cabinet and through the door insulation.

Gaugler discloses a refrigerating apparatus where the top and side walls are insulated and the insulation panel or construction is of a bag-like design including an outer protective bag within which there is disposed a layer of compressible insulation and an inner gas-filled hermetically sealed bag containing fibrous insulation. As can readily be noted, this reference focuses specifically on the varying insulation concepts and characteristics and does not direct its attention at all to how this insulation may be placed in a refrigerator door with a porous or permeable outer skin in combination with door vent openings for the natural flow of air through the encased door insulation.

With the exception of Richard and Arthur, which do provide some type of vent or orifice through the refrigerator door panel into the door insulation, the remaining references listed above employ insulation concepts in combination with some type of appliance or cabinet where the interior and exterior panels are solid. The enclosed insulation is sealed inbetween these two panels and is isolated from the outside atmosphere and from any air or moisture flow communication. One effect of this isolation and the lack of any air or moisture flow through the insulation is to allow condensation and ice buildup in the insulation. When such condensation and ice buildup occurs, the insulating value of the door insulation is reduced thus making the overall refrigerator operation less efficient.

The present invention provides a solution to the aforementioned deficiencies of typical or conventional refrigerator door designs by providing vent holes in the inside refrigerator door panel. By means of these vent holes, a natural flow path for air and moisture is provided from the interior of the refrigerator through the door insulation. The flow prevents condensation and ice buildup in the encased door insulation. As a result, the insulating value remains as originally designed and the designed or intended efficiency is not lessened.

With regard to the Arthur reference, there is a single orifice provided but the insulation panel is not really a panel and not a self-contained unit. Rather, the insulation which is placed in the door is either loosely arranged discrete particle insulation or may be foamed in place. Whatever the particular method to get the insulation material properly arranged in the door, there are a number of manufacturing inefficiencies and problems. If loose discrete particulate insulation is utilized, then a great deal of care must be taken so as to arrange it uniformly and to avoid any shifting or compacting so that the insulating characteristics throughout are uniform. There are also significant concerns over handling and the health risks due to air-borne particulate. There is very little served by an insulation design for a refrigerator cabinet if the insulation across the entire surface area of the door is not uniform. If foam-in-place insulation is used for the insulation in the door, then there may not be a suitable cell structure for the insulation or insulation density in order to allow an adequate flow through of air to prevent the buildup of ice or condensation. The release of fluorocarbons by such foam insulation also presents a substantial health risk and environmental hazard. Another concern with the Arthur structure is that there is but a single orifice and thus it is difficult to envision how any type of realistic flow pattern could be achieved so as to maintain the entirety of the encased insulation material free of any condensation or ice buildup. A great number of advantages are believed to be provided by the present invention not only by its encased insulation panel which may be assembled off-line under better-controlled and safer conditions and then assembled within the inner and outer panels of the door, but the specific design of two series of vent openings in the inner door panel enables a flow-through design.

With regard to the Richard disclosure, it includes the same deficiencies as Arthur as to the design of an insulation panel. The Richard insulation is rock wool and must be handled, arranged and packed into outer shell 22 at the time of door assembly. This insulation is not pre-packaged in any type of pouch or envelope to facilitate handling, usage and assembly. Since Richard does not disclose a Panel but rather simply loose insulation which is arranged between an inner and outer wall, the same concerns as in Arthur as to the uniformity of the insulation arrangement, its density and the ability for an adequate flow through are all present.

SUMMARY OF THE INVENTION

An insulated refrigerator door designed and arranged to enable a flow path for air from the interior of the refrigerator through the door insulation according to one embodiment of the present invention comprises an outer door panel, an inner door panel including a plurality of vent holes and an insulation panel disposed between the inner and outer door panels, the insulation panel including a permeable inner layer positioned adjacent the inner door panel, an outer layer positioned adjacent the outer door panel and insulation material disposed between the inner and outer layers, the vent holes being designed and arranged in flow communication with the insulation material by way of the permeable inner layer.

One object of the present invention is to provide an improved insulation refrigerator door design.

Related objects and advantages of the present invention will be apparent from the following description.

DESCRIPTION OF THE PREFERRED EMBODIMENT

Figure 1:
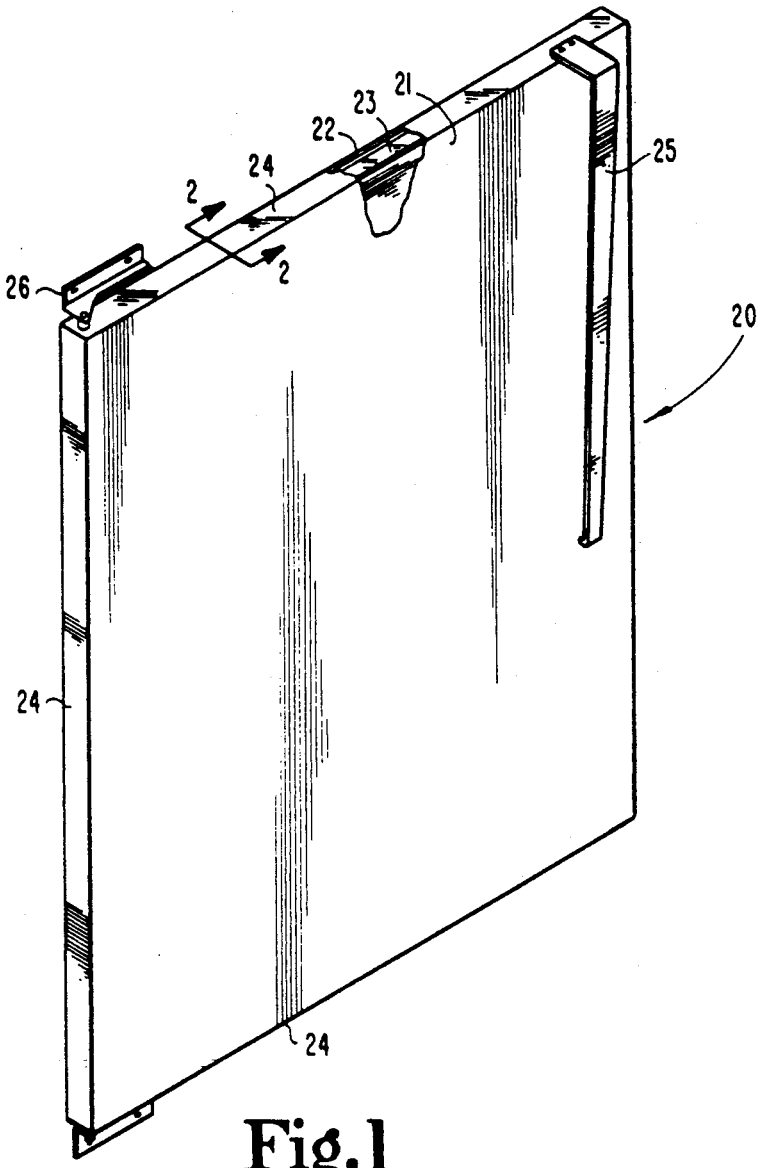
FIG. 1 is a fragmentary, perspective view of a refrigerator door according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, there is illustrated a refrigerator door 20 according to a typical embodiment of the present invention. Door 20 includes a generally rectangular outer panel 21, a generally rectangular inner panel 22 and a generally rectangular, flexible insulation panel 23 which is disposed between the inner and outer panels. The perimeter frame denoted by edge 24, arranged into four sides, is integral with outer panel 21 (see FIG. 5). An optional construction for the four sides comprising edge 24 is to separately fabricate a generally rectangular frame and assemble it around the three laminated panels so as to enclose and encase the insulation panel between the inner and outer door panels. Door 20 also includes a handle 25 and hinges 26. The exterior may be finished (enameled) in a variety of colors so as to color-coordinate the kitchen with the other appliances. Chrome trim may also be added to the edges and corners in order to protect and to provide an improved appearance. Finally, a synthetic gasket or seal (not illustrated) is disposed around the rectangular periphery of door 20 in order to establish a suitable seal against the opening to the remainder of the refrigerator cabinet.

Figure 2:
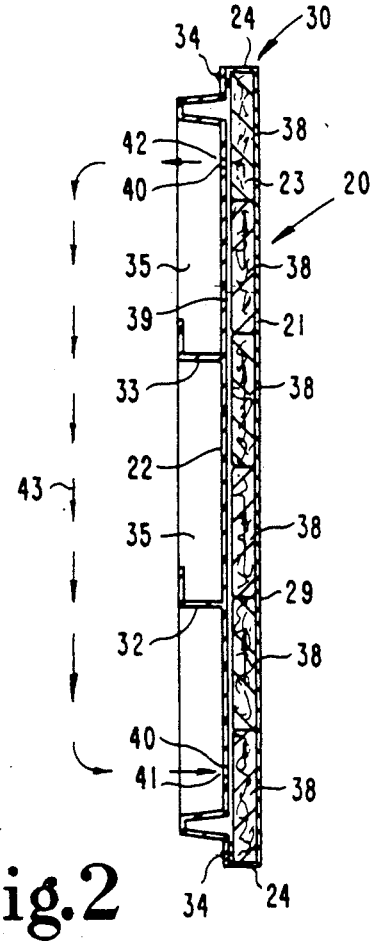
FIG. 2 is a side elevational view, in full section, of the FIG. 1 refrigerator door as viewed along line 2—2 in FIG. 1.

Referring to FIG. 2, a side elevational view of door 20 in full section is illustrated showing the internal details of construction and assembly of outer panel 21, inner panel 22 and an insulation panel. The insulation panel is preferably configured as panel 67 in FIGS. 6 and 7, but is referred to at this point with regard to FIG. 2 in a generic sense as panel 23. However, in the FIG. 2 illustration, the insulation panel has the individual pouches or compartments which are illustrated with regard to panel 67. Outer panel 21 includes an outer layer or skin 29 which is integral with a generally rectangular frame 30 which provides perimeter edge 24. Inner panel 23 is configured with in-door storage compartments via selves 32 and 33 and is assembled to outer panel 21 by threaded fasteners 34. An inwardly protruding, generally rectangular frame 35 which is an integral part of inner panel 22 provides an enclosing structure to shelves 32 and 33.

A specific configuration of insulation panel 23 is arranged with a series of pouches 38 which are vertically compressed and recessed into frame 30 and horizontally sandwiched between skin 29 and the innermost layer 39 of inner panel 22. Disposed in layer 39 are two series of vent holes 40 arranged in two spaced-apart rows at 41 and 42. These two series of vent holes enable a natural flow of air and moisture through the individual pouches 38 of insulation as denoted by arrow path 43. The circulation of the referenced air and moisture is with the atmosphere of the interior of the refrigerator cabinet (main body). This circulation of air and moisture prevents condensation and ice buildup in the insulation of panel 23 and precludes any decline or reduction in the insulating properties of insulation panel 23.

Figures 3, 4, 5:
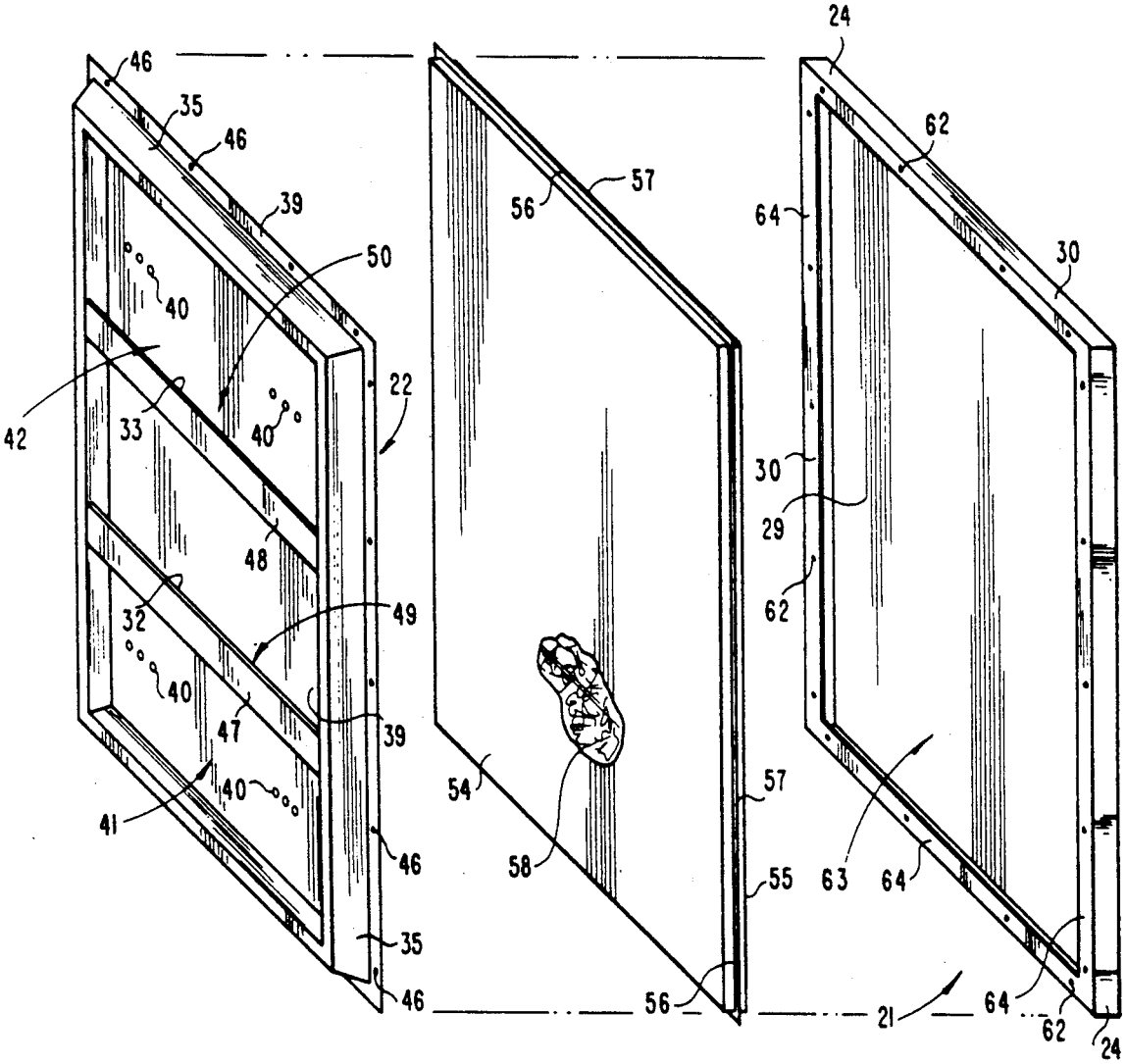
FIG. 3 is a perspective view of the inner panel of the FIG. 1 refrigerator door.
FIG. 4 is a perspective view of the insulation panel of the FIG. 1 refrigerator door.
FIG. 5 is a perspective view of the outer panel of the FIG. 1 refrigerator door.

Referring to FIG. 3, the details of inner door panel 22 are illustrated, including layer 39, shelves 32 and 33, lower series 41 of vent holes 40 and upper series 42 of vent holes 40 and frame 35. Holes 46 receive threaded fasteners 34 for attachment of the inner door panel to the outer door panel frame. Front panels 47 and 48 are disposed in front of shelves 32 and 33, respectively, and in combination with frame 35 create storage compartments 49 and 50.

The interior of the inner panel 22 may be arranged with compartments 49 and 50 as illustrated or alternatively with any type of shaped compartment either open or covered. Typically refrigerator doors are styled with recesses for eggs, closed compartments for butter, shelves for bottles, and so forth. The material for inner panel 22 may be any one of several moldable, rigid plastic such that the entirety of the inner panel may be molded as an integral unit. One variation to this integrally molded construction is to configure front panels 47 and 48 as removable members for easier cleaning.

Referring to FIG. 4, insulation panel 23 is illustrated in generic form consisting of a flexible inner enclosing layer 54 and a flexible outer enclosing layer 55 which are sealed together at their abutting perimeter edges 56 and 57 in order to enclose a pad 58 of insulation material which may be cut from a mat or batt and sized to cover the entire door or may be a mass of loose, discrete insulation organized into a pad-like panel. Inner enclosing layer 54 is porous or permeable so as to enable the flow through of air and moisture as indicated by arrow path 43. While a generic form of insulation panel is illustrated in FIG. 4, a more specialized structure for panel 23 is illustrated in FIGS. 6 and 7.

Referring to FIG. 5, outer panel 21 is illustrated in greater detail, including outer layer 29, perimeter edge 24, frame 30 and internally threaded holes 62. Frame 30 has a generally rectangular perimeter and the four side walls each have a generally rectangular lateral cross section. Due to the thickness of frame 30 extending from layer 29 toward the interior of the refrigerator cabinet, a generally rectangular, recessed area 63 is defined by frame 30 and layer 29. It is recessed area 63 which receives insulation panel 23 and panel 23 is received completely such that when layer 39 is attached to surface 64 of frame 30, the insulation panel is completely encased. Threaded holes 62 receive fasteners 34 which are initially received by holes 46 in layer 39.

Figure 6:
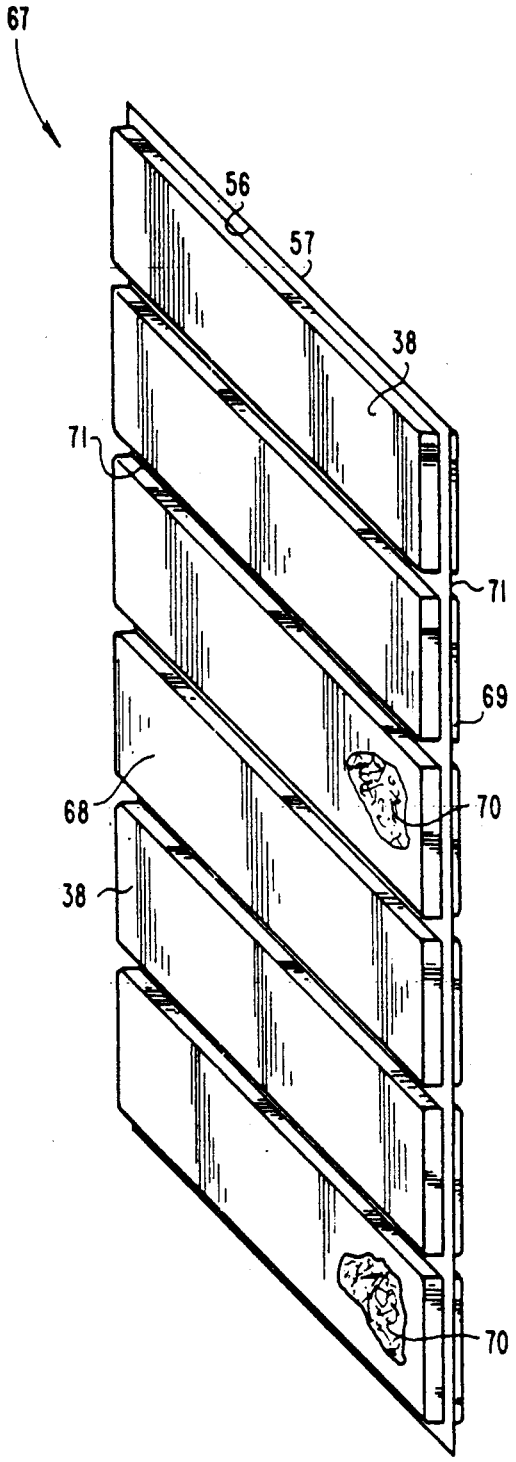
FIG. 6 is a perspective view of an insulation panel suitable for use in the FIG. 1 refrigerator door as configured and arranged in a free state.
Figure 7:
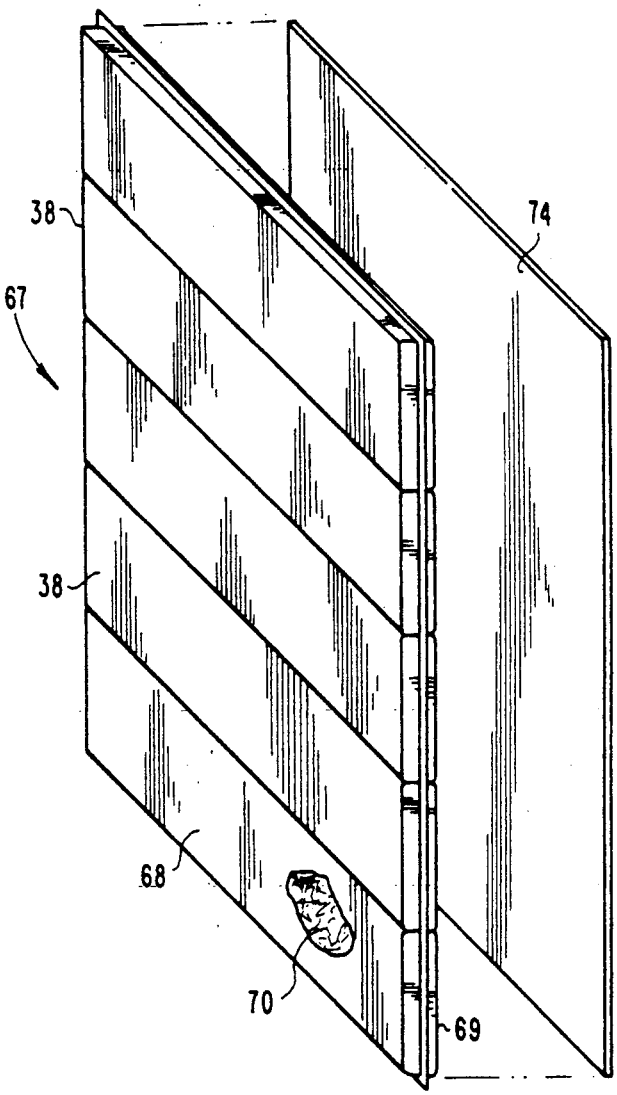
FIG. 7 is a perspective view of the FIG. 6 insulation panel in a compressed state ready for assembly into the FIG. 1 refrigerator door.

Referring to FIGS. 6 and 7, a specific style of flexible insulation panel 23 is illustrated as previously explained with reference to FIG. 2. Insulation panel 67 is a specific configuration which is sized and styled to fit within recessed area 63 and is to be encased by inner and outer door panels 21 and 22. Insulation panel 67 begins with two generally rectangular sheets 68 and 69 of enclosing material and a mass of loose, discrete insulation material 70 disposed therebetween. The two sheets of enclosing material are sealed together along their peripheral edges so as to define an insulation-filled cavity. The material for sheet 68 is an air and moisture-permeable material so as to enable the air and moisture flow of arrow path 43 through the vent holes, through the inner sheet 68 and through the loose, discrete insulation material 70.

Panel 67 is arranged into compartments or pouches 38 which are similar rectangular solids, arranged in a generally parallel, side-by-side manner. In order to create these pouches, the two sheets of enclosing material are intermittently sealed at sealed lines or seams 71. The fact that these sealed lines are not complete seals from side to side, but rather intermittent, air and moisture flow is permitted between adjacent pouches. In order to create the pouches and to intermittently seal the space between adjacent pouches, it is preferable to shift the insulation so that it is not caught inbetween pouches such that it would interfere with the sealing of the enclosing sheets between pouches. Of course, some trapped insulation material could actually contribute to the flow of air and moisture between adjacent pouches, but it is preferred to move the insulation so that it is not trapped.

An alternative configuration or construction for panel 67 and pouches 38 is to actually pre-make the individual pouches and fill them with insulation prior to assembly of the pouches together into panel 67. This assembly is achieved by connecting the perimeter edges (sealed flanges) which define each pouch. Since these edges are completely sealed around their entire perimeter, pouch-to-pouch communication (flow) of air and moisture will be by way of the porous or permeable layer 54 which material is disposed on one side and the same facing side of each pouch 38. When these pouches are compressed, an end portion of layer 54 of one pouch is in abutting contact with the same portion of the adjacent pouch. The air and moisture flow passes from pouch to pouch via flow through layers 54.

In the "free" state of natural extension as illustrated in FIG. 6, panel 67 is longer in the vertical dimension than the height of recessed area 63. As a consequence of this dimensional difference, the free state of panel 67 will not fit within area 63. In order to fit panel 67 within area 63, the panel is compressed in the vertical direction so as to force adjacent pouches 38 into tight abutment against each other as is illustrated by the solid rectangular form of panel 67 in FIG. 7. As the pouches are compressed vertically, the separation or spacing represented by sealed lines or seams 71 in effect vanishes and compressed panel 67 is sized to fit within recessed area 63. As an option to hold the compressed-together pouches 38 in position, outer layer 55 may be bonded to retaining sheet 74. Since layer 55 does not need to be permeable to air and moisture flow for the present invention, this layer can be sealed by bonding to the retaining sheet 74. This assembly of panel 67 and sheet 74 is installed into recessed area 63 and sheet 74 is placed against skin 29.

While the invention has been illustrated and described in detail in the drawings and foregoing description, the same is to be considered as illustrative and not restrictive in character, it being understood that only the preferred embodiment has been shown and described and that all changes and modifications that cone within the spirit of the invention are desired to be protected.

What is claimed is:

1. An insulated refrigerator door which is designed and arranged to enable the natural flow of air from the lower interior of the refrigerator up through the door insulation and back to the upper interior of the refrigerator, said insulated refrigerator door comprising:

an outer door panel;

an inner door panel defining therein a plurality of vent holes positioned in a series across the lower portion of said panel and a plurality of vent holes positioned in a series across the upper portion of said panel; and an insulation panel disposed and filling the cavity between said inner and outer door panels and including a flexible permeable layer positioned adjacent to the interior surfaces of said inner and outer door panels, insulation material being disposed between said inner and outer panels and within said flexible permeable layer, said vent holes being designed and arranged for flow communication with said insulation material by way of said flexible permeable layer, wherein said insulation panel is arranged with a plurality of pouches constructed from material comprising said flexible permeable layer, each pouch being filled with insulation and separated from each other by a seam.

2. The insulated refrigerator door of claim 1 wherein said outer door panel includes an inner skin and a surrounding frame which defines a recessed area, said insulation panel being received within and filling said recessed area.

3. An insulated refrigerator door which is designed and arranged to enable the natural flow of air from the lower interior of the refrigerator up through the door insulation and back to the upper interior of the refrigerator, said refrigerator door comprising:

a generally rectangular first door panel;

a generally rectangular second door panel including vent means for enabling air flow through said second door panel;

an insulation panel disposed and filling the cavity between said first and second door panels and including a flexible porous enclosing skin, wherein said insulation panel is arranged with a plurality of pouches constructed from material comprising said flexible porous enclosing skin, each filled with insulation material and separated from each other by a seam; and fastener means for joining together said first and second door panels.

4. The insulated refrigerator door of claim 3 wherein said insulation material is loose, discrete insulation.

* * * * *